US005690160A

United States Patent [19]

Sutton et al.

[11] Patent Number: 5,690,160

[45] Date of Patent: Nov. 25, 1997

[54] SEALING DEVICE FOR AN-INLET OF A SAND MOLD

[75] Inventors: Thomas Leonard Sutton, Preston; John Campbell; Michael Joseph Flynn, both of Worcester; Gary McBain, Cleveleys, all of United Kingdom

[73] Assignee: Alloy Technologies Limited, England

[21] Appl. No.: 535,180

[22] PCT Filed: Apr. 28, 1994

[86] PCT No.: PCT/GB94/00913

§ 371 Date: Jan. 16, 1996

§ 102(e) Date: Jan. 16, 1996

[87] PCT Pub. No.: WO94/25200

PCT Pub. Date: Nov. 10, 1994

[30] Foreign Application Priority Data

Apr. 29, 1993 [GB] United Kingdom ..... 9308833

[51] Int. Cl.[6] ..... B22D 35/04

[52] U.S. Cl. ..... 164/136; 164/323; 164/337

[58] Field of Search ..... 164/133, 136, 164/167, 323, 322, 337

[56] References Cited

U.S. PATENT DOCUMENTS

| | | | |
|---|---|---|---|
| 3,905,419 | 9/1975 | Tenner . | |
| 4,733,714 | 3/1988 | Smith | 164/136 |

FOREIGN PATENT DOCUMENTS

| | | | |
|---|---|---|---|
| A 2506648 | 8/1976 | Germany . | |
| 61-189860 | 8/1986 | Japan | 164/133 |
| A93 11892 | 6/1993 | WIPO . | |

*Primary Examiner*—Kuang Y. Lin

*Attorney, Agent, or Firm*—Pravel, Hewitt, Kimball & Krieger

[57] ABSTRACT

A sand mould has a filling inlet defined by a solid insert (7). The insert provides a flat outer face for sealing and subsequently heat exchanging sliding contact with a sealing face of a chill plate (11). The mould is filled through the insert and then closed by means of the chill plate.

11 Claims, 1 Drawing Sheet

SEALING DEVICE FOR AN-INLET OF A SAND MOLD

BACKGROUND OF THE INVENTION

1. Field of the Invention

This invention relates to a sand mould and a method of filling the same. The invention is particularly but not exclusively concerned with the casting of light metal alloys, e.g. of aluminium or magnesium, as described in our PCT Application No. GB 92/02268 (hereinafter referred to as the PCT Application) the contents of which are incorporated herein by reference.

2. Description of Prior Art

According to one aspect of the invention of the PCT Application there is provided a sealing device for an inlet of a sand mould, comprising a filling opening and a chill plate having a sealing face for sliding contact with an inlet side of the mould between a filling position in which the filling opening registers with the mould inlet and a sealing position in which the inlet is closed by the sealing face for a period of time sufficient to permit solidification of the metal in the inlet. According to another aspect of the invention of the PCT Application there is provided casting apparatus comprising means for making a sand mould with a vertical parting line and filling means for filling the mould with molten metal, wherein the filling means is adapted to bottom-fill the mould in a manner permitting control of flow velocity and pressure. Although the sealing device of the PCT Application is primarily intended for use in such casting apparatus for casting light metal alloys, e.g. of aluminium or magnesium, the sealing device may have wider application, e.g. in relation to other low pressure sand casting processes (e.g. the Cosworth process described in the PCT Application).

SUMMARY OF THE INVENTION

The present invention is concerned with an improvement in or modification of the sealing device of the PCT Application. The prior sealing device has a chill plate with a cutting or forming leading edge for making a smooth contact face in the inlet side of the mould during the sliding movement. In the present invention the sealing face of the chill plate still makes sliding contact with the inlet side of the mould but the inlet side of the mould is defined by a solid insert of a suitable thermal material defining the filling inlet of the mould and providing a flat outer face for heat exchanging sliding contact with the sealing face of the chill plate.

In accordance with the present invention, there is provided a method of sealing a sand mould having a filling inlet, comprising making the mould with a (preferably solid) insert of thermally suitable material defining said inlet and providing a flat outer face for sealing and subsequently heat exchanging sliding contact with a sealing face of a chill plate, filling the mould through said insert, and closing the mould by means of said chill plate.

Preferably, a succession of said moulds is produced by forming identical half-moulds each having a front face defining the rear part of the mould cavity of one mould and a rear face defining the front part of the mould cavity of the next following mould, the inserts of adjacent moulds being arranged in line in a common plane.

According to a further aspect of the present invention there is provided a sand mould having a filling inlet defined by a (preferably solid) insert of thermally suitable material providing a flat outer face for sealing and subsequently heat exchanging sliding contact with a sealing face of a chill plate.

BRIEF DESCRIPTION OF THE DRAWINGS

The invention will now be further described by way of example only with reference to the accompanying drawings, in which.

DESCRIPTION OF THE PREFERRED EMBODIMENT

A pack or line of green sand moulds is made by the casting apparatus described in the PCT Application for the casting of light alloy metal products. Mould halves are formed in a compaction zone to which green sand is supplied from a hopper. The exit end of the compaction zone is defined by a swing plate defining the profile of the front face of a half mould. The rear profile of the half mould is defined by a piston which is advanced to compress the sand to form and then eject a fresh half mould. The half moulds are then assembled in adjacent relationship such that the rear face of one half mould defines the front part of a mould cavity of which the rear part is defined by the front face of the next following half mould.

Figure 1:
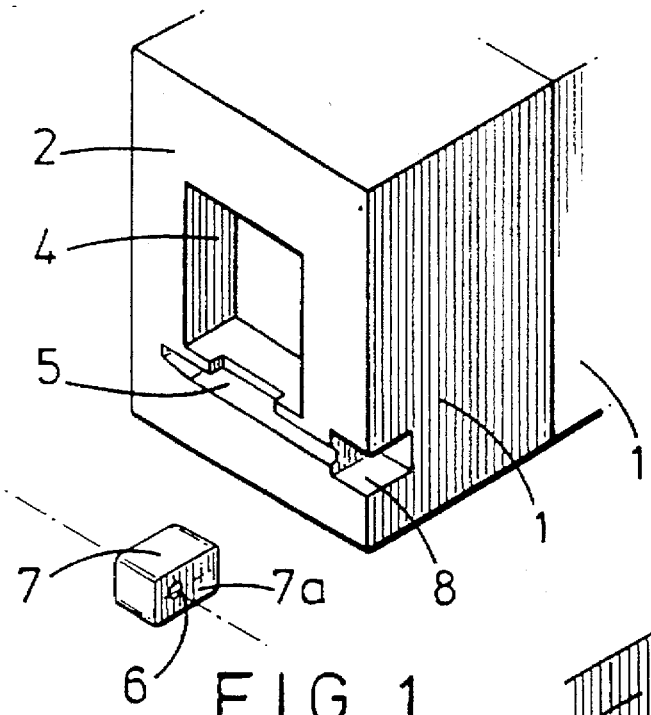
FIG. 1 is a diagrammatic perspective view of a line of sand moulds in section on the parting line of the foremost mould.
Figure 2:
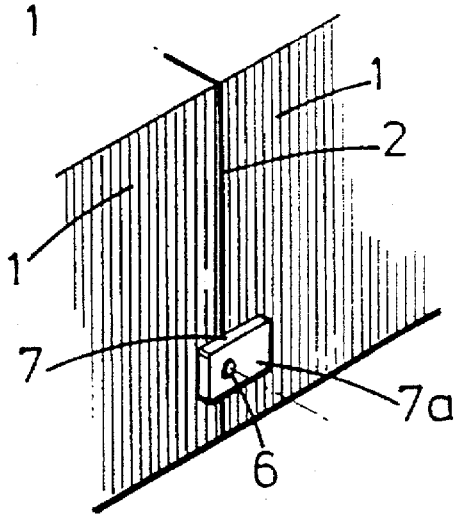
FIG. 2 shows the assembled moulds.
Figure 3:
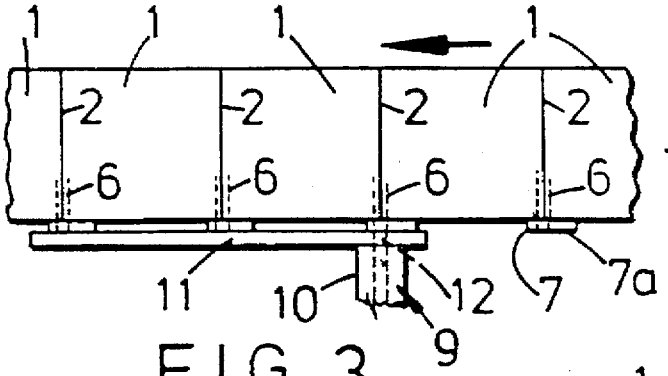
FIG. 3 is a plan view showing a mould in a filling position.
Figure 4:
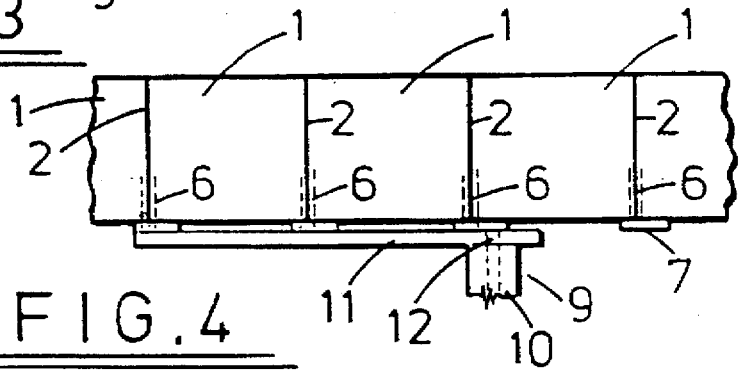
FIG. 4 is a corresponding view showing the same mould in the sealing position.

Such a continuous line or pack of green sand moulds made of adjacent mould halves 1 with vertical parting lines 2 so produced is shown in the drawings and the mould pack is then indexed past a filling station 3 at which each mould is bottom-filled. Each mould has a casting cavity 4 connected by a gate and runner system 5 to an inlet 6 which in this case is defined by a solid insert 7 of thermally suitable material (e.g. silicon or boron nitride or chemically bonded sand) which is located in a correspondingly shaped pocket 8 during mould manufacture. The insert 7 may be of any suitable shape but preferably has the shape of a generally rectangular block with a through passage (the inlet 6) registering with the mould runner 5. The outer face 7*a* of the insert 7 is flat and as shown in FIGS. 2 to 4 extends outwardly from the outer face of the mould. Successive inserts 7 are aligned and the outer faces 7*a* are disposed in a common plane. Alternatively, the inserts 7 may be completely accommodated within their pockets so that the outer faces 7*a* are flush with the side surfaces of the respective moulds.

The outer face 7*a* of the insert 7 provides a manufactured sealing face to seat against a pump mechanism nozzle and chilling device 9. The insert 7 is placed in position by automated or manual means after or during mould closure and remains with the mould for the full period of its life, i.e. until the solidified casting is separated from the mould. Although the above description has related to vertically produced moulds it will be appreciated that the insert may also be used with horizontally produced moulds.

As shown in FIGS. 3 and 4, the filling station comprises a pump nozzle 10 integral with a chili or sealing plate 11. The pump nozzle 10 can be aligned with the mould filling opening 6 in an insert 7 when the line of moulds is stationary and in this position the sealing plate 11 extends over the inserts 7 of a plurality (in this case two) of previously filled moulds. On relative movement between the line of moulds and the filling device (e.g. by indexing of the mould string in the direction of the arrow in FIG. 3 or by indexing the plate 11 and pump 10 in the opposite direction) the chill plate 11 slides over the inserts 7 so as to close the inlet 6 of the mould that has just been filled. This inlet 6 then remains in contact with the chill plate 11 during the course of a number (in this case two) of further filling operations thereby allowing sufficient time for sufficient metal in the inlet 6 to solidify before the insert 7 disengages the chill plate 11. The sealing plate 11 of the filling device 9 may be of any desired length so as to allow time for sufficient metal in the insert device 7 to solidify. Once the mould is moved from the primary position, in which metal is being pumped into the mould, to the secondary position, in which the insert device 7 is sealed against the chill plate 11, the pump pressure can be relieved and molten metal at the nozzle returned back to the pump neck. The mould pack may now index the remainder of a full mould thickness and a further cycle is performed allowing a new mould and insert device 7 to arrive for filling. The recently filled mould has indexed along the sealing plate to allow cooling and thus sealing by at least partial solidification of the runner. The hydrostatic pressure from within the mould cavity now acts upon a blank face of the sealing plate until the runner is sealed by at least partial solidification.

As in the case of the filling device described in the PCT Application, the filling opening 12 in the chill plate 11 connected to the pump nozzle 10 may be lined by a ceramic sleeve and the sealing face of the chill plate 11 may be cooled by coolant circulating in an internal passageway (not shown). The chill plate 11 is of elongate rectangular shape in side elevation.

We claim:

1. A method of sealing a sand mould having a filling inlet, comprising making the mould with an insert of thermally suitable material defining said inlet and providing a flat outer face for sealing and subsequently heat exchanging sliding contact with a sealing face of a chill plate, filling the mould through said insert, and closing the mould by means of said chill plate.

2. A method as claimed in claim 1, wherein a succession of said moulds is produced by forming identical half-moulds each having a front face defining the rear part of the mould cavity of one mould and a rear face defining the front part of the mould cavity of the next following mould, the inserts of adjacent moulds being arranged in line in a common plane.

3. A method as claimed in claim 1, wherein the or each insert is mounted in a pocket intersected by a parting line of the mould.

4. A method as claimed in claim 3, wherein the mould parting line is vertical.

5. A method as claimed in claim 1, wherein the outer face of the or each insert extends outwardly from the respective side face of the mould.

6. A method as claimed in claim 1, wherein the length of the chill plate is greater than the spacing between successive inserts.

7. A method as claimed in claim 1, wherein a filling nozzle is integral with the chill plate.

8. The method of claim 1, wherein the insert is solid.

9. A casting apparatus comprising:

sand mould;

said mould having a filling inlet defined by an insert of thermally suitable material;

a chill plate having a sealing face;

said mould providing a flat outer face for sealing and subsequent heat exchanging sliding contact with the sealing face of the chill plate.

10. The casting apparatus of claim 9, wherein the outer face of the insert extends outwardly from the respective side face of the mould.

11. The casting apparatus of claim 9, wherein the insert is solid.

* * * * *